US010233781B2

(12) United States Patent
Vo et al.

(10) Patent No.: US 10,233,781 B2
(45) Date of Patent: Mar. 19, 2019

(54) TIE ROD CONNECTION FOR MID-TURBINE FRAME

(71) Applicant: UNITED TECHNOLOGIES CORPORATION, Farmington, CT (US)

(72) Inventors: Tuan David Vo, Middletown, CT (US); Alan Lees, Manchester, CT (US)

(73) Assignee: United Technologies Corporation, Farmington, CT (US)

( * ) Notice: Subject to any disclaimer, the term of this patent is extended or adjusted under 35 U.S.C. 154(b) by 379 days.

(21) Appl. No.: 15/107,530

(22) PCT Filed: Jan. 21, 2015

(86) PCT No.: PCT/US2015/012128
§ 371 (c)(1),
(2) Date: Jun. 23, 2016

(87) PCT Pub. No.: WO2015/156882
PCT Pub. Date: Oct. 15, 2015

(65) Prior Publication Data

US 2016/0333739 A1 Nov. 17, 2016

Related U.S. Application Data

(60) Provisional application No. 61/944,600, filed on Feb. 26, 2014.

(51) Int. Cl.
*F01D 25/24* (2006.01)
*F01D 25/16* (2006.01)
(Continued)

(52) U.S. Cl.
CPC ..... *F01D 25/243* (2013.01); *F01D 5/06* (2013.01); *F01D 9/02* (2013.01); *F01D 9/065* (2013.01);
(Continued)

(58) Field of Classification Search
CPC ... F01D 5/06; F01D 9/02; F01D 9/065; F01D 25/162; F01D 25/243; F05D 2220/32; F05D 2230/60; F05D 2250/312; F05D 2260/31
See application file for complete search history.

(56) References Cited

U.S. PATENT DOCUMENTS 5,483,792 A 1/1996 Czachor et al.
5,545,011 A 8/1996 Molin et al.
(Continued)

FOREIGN PATENT DOCUMENTS

EP 2192274 A2 6/2010
EP 3032040 A1 6/2016
EP 3045671 A1 7/2016

OTHER PUBLICATIONS

International Search Report and Written Opinion for PCT Application No. PCT/US2015/012128, dated Oct. 21, 2015.
(Continued)

*Primary Examiner* — Igor Kershteyn
(74) *Attorney, Agent, or Firm* — Carlson, Gaskey & Olds, P.C.

(57) ABSTRACT

A mid-turbine frame for use in a gas turbine engine comprises at least one vane extending between a vane inner platform and a vane outer platform, and an inner case radially inward of the inner platform. A plurality of tie rods extend from a platform radially inward of the inner case to a radially outer location which is secured by a mount member. The tie rods are secured in the inner case by a forward bolt, and at least one rear bolt, with the forward bolt extending along an axis which is non-parallel to a center axis of the inner case. A gas turbine engine and a method for assembling a mid-turbine frame are also disclosed.

20 Claims, 3 Drawing Sheets

(51) Int. Cl.

| | |
|---|---|
| ***F01D 5/06*** | (2006.01) |
| ***F02D 9/02*** | (2006.01) |
| ***F01D 9/02*** | (2006.01) |
| ***F01D 9/06*** | (2006.01) |

(52) U.S. Cl.
CPC ..... *F01D 25/162* (2013.01); *F05D 2220/32* (2013.01); *F05D 2230/60* (2013.01); *F05D 2250/312* (2013.01); *F05D 2260/31* (2013.01)

(56) References Cited

U.S. PATENT DOCUMENTS

| | | | | |
|---|---|---|---|---|
| 2003/0185671 | A1 | 10/2003 | Boeck et al. | |
| 2004/0240987 | A1 | 12/2004 | Czachor et al. | |
| 2010/0132373 | A1* | 6/2010 | Durocher | F01D 9/065 60/796 |
| 2013/0052006 | A1 | 2/2013 | Petty | |
| 2013/0067930 | A1 | 3/2013 | Paradis | |
| 2013/0192256 | A1* | 8/2013 | Suciu | F02K 3/06 60/796 |
| 2014/0013770 | A1 | 1/2014 | Farah et al. | |
| 2016/0208646 | A1* | 7/2016 | Winn | F01D 25/12 |
| 2016/0348591 | A1* | 12/2016 | Suciu | F01D 9/042 |

OTHER PUBLICATIONS

Supplementary European Search Report for European Application No. 15777050.4 dated Feb. 1, 2017.
International Preliminary Report on Patentability for International Application No. PCT/US2015/012128 dated Sep. 9, 2016.

* cited by examiner

TIE ROD CONNECTION FOR MID-TURBINE FRAME

CROSS-REFERENCE TO RELATED APPLICATION

This application claims priority to U.S. Provisional Patent Application No. 61/944,600, filed Feb. 26, 2014.

BACKGROUND OF THE INVENTION

This application relates to tie rods which provide structural support in a mid-turbine frame for a gas turbine engine.

Gas turbine engines are known and, typically, include a fan delivering air into a bypass duct as propulsion air. The fan also delivers air into a core engine where it passes to a compressor. The air is compressed and delivered into a combustion section where it is mixed with fuel and ignited. Products of this combustion pass downstream over turbine rotors driving them to rotate.

Most gas turbine engines include more than one turbine rotor. In many gas turbine engines, there is a vane stage positioned downstream of an upstream turbine rotor, and upstream of the downstream turbine rotor to properly direct the products of combustion from the upstream turbine rotor toward the downstream turbine rotor.

These vanes may be mounted in a mid-turbine frame, which may also mount a bearing for one of the shafts.

SUMMARY OF THE INVENTION

In a featured embodiment, a mid-turbine frame for use in a gas turbine engine comprises at least one vane extending between a vane inner platform and a vane outer platform, and an inner case radially inward of the inner platform. A plurality of tie rods extend from a platform radially inward of the inner case to a radially outer location which is secured by a mount member. The tie rods are secured in the inner case by a forward bolt, and at least one rear bolt, with the forward bolt extending along an axis which is non-parallel to a center axis of the inner case.

In another embodiment according to the previous embodiment, the bolt extends along an angle relative to a line parallel to the center axis. The angle is greater than or equal to 1 degree and less than or equal to 7 degrees and extending radially inwardly relative to the center axis.

In another embodiment according to any of the previous embodiments, there are a pair of the rear bolts extending through the inner case and into the inner platform of the tie rods and extending generally parallel to an axis of the tie rod.

In another embodiment according to any of the previous embodiments, a downstream most bolt extends through an inwardly extending downstream flange on the inner case, and into the tie rod platform.

In another embodiment according to any of the previous embodiments, a pair of rear bolts extend through the inner case and into the inner platform of the tie rods generally parallel to an axis of the tie rod.

In another embodiment according to any of the previous embodiments, a downstream most bolt extends through an inwardly extending downstream flange on the inner case, and into the tie rod platform.

In another embodiment according to any of the previous embodiments, a downstream most bolt extend through an inwardly extending downstream flange on the inner case, and into the tie rod platform.

In another embodiment according to any of the previous embodiments, the tie rods have threads at a radially outer end. The threads are secured to the mount member.

In another featured embodiment, a gas turbine engine comprises a compressor and a turbine section. The turbine has at least an upstream turbine rotor and a downstream turbine rotor, and a mid-turbine frame mounted between the upstream and downstream turbine rotor. The mid-turbine frame includes at least one vane extending between a vane inner platform and a vane outer platform, an inner case radially inward of the inner platform, and a plurality of tie rods extending from a platform radially inward of the inner case to a radially outer location which is secured by a mount member. The tie rods are secured in the inner case by a forward bolt, and at least one rear bolt, with the forward bolt extending along an axis which is non-parallel to a center axis of the inner case.

In another embodiment according to the previous embodiment, the bolt extends along an angle relative to a line parallel to the center axis. The angle is greater than or equal to 1 degree and less than or equal to 7 degrees and extends radially inwardly relative to the center axis.

In another embodiment according to any of the previous embodiments, there are a pair of rear bolts extending through the inner case and into the inner platform of the tie rods generally parallel to an axis of the tie rod.

In another embodiment according to any of the previous embodiments, a downstream most bolt extends through an inwardly extending downstream flange on the inner case, and into the tie rod platform.

In another embodiment according to any of the previous embodiments, the tie rods have threads at a radially outer end. The threads are secured to the mount member.

In another embodiment according to any of the previous embodiments, a pair of the rear bolts extends through the inner case and into the inner platform of the tie rods generally parallel to an axis of the tie rod.

In another embodiment according to any of the previous embodiments, a downstream most bolt extends through an inwardly extending downstream flange on the inner case, and into the tie rod platform.

In another embodiment according to any of the previous embodiments, the tie rods have threads at a radially outer end. The threads are secured to the mount member.

In another embodiment according to any of the previous embodiments, a downstream most bolt extends through an inwardly extending downstream flange on the inner case, and into the tie rod platform.

In another featured embodiment, a method for assembling a mid-turbine frame for a gas turbine engine comprises passing a plurality of tie rods radially outwardly through openings in an inner case having a platform positioned radially inwardly of the inner case, and securing the inner case to the platform of the tie rods with a forward bolt. The tie rods are then secured within a housing of a gas turbine engine.

In another embodiment according to the previous embodiment, the forward extends along an angle relative to a line parallel to a center axis of the inner case. The angle is greater than or equal to 1 degree and less than or equal to 7 degrees and extends radially inwardly relative to the center axis.

In another embodiment according to any of the previous embodiments, a pair of rear bolts extends through the inner case and into the platform of the tie rods and extends generally parallel to an axis of the tie rod/A downstream most bolt extends through an inwardly extending downstream flange on the inner case, and into the platform.

These and other features may be best understood from the following drawings and specification.

DETAILED DESCRIPTION

Figure 1:
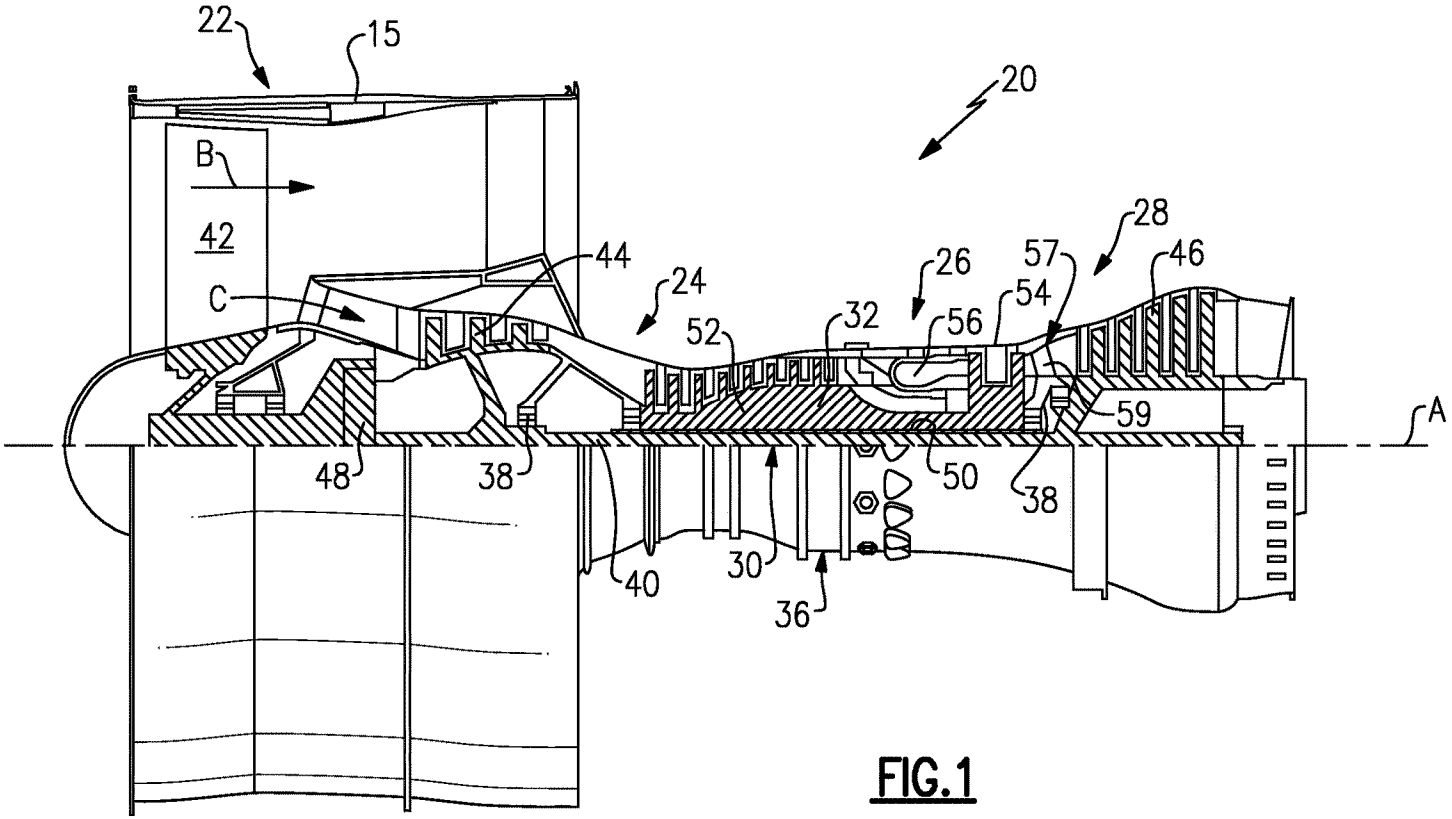
FIG. 1 schematically shows a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
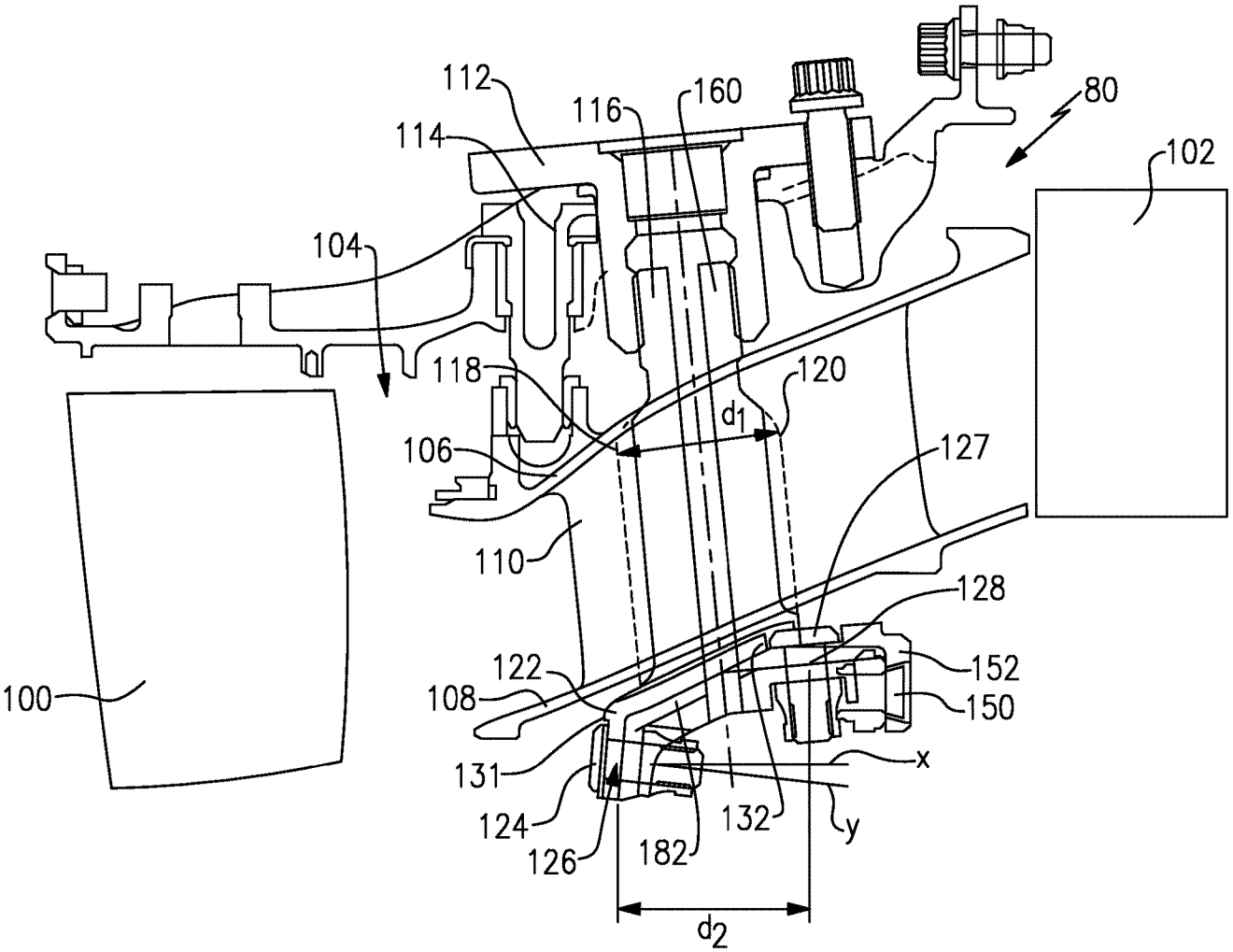
FIG. 2 shows a mid-turbine frame.

An upstream turbine rotor 100, which may be the high pressure turbine rotor 54 of FIG. 1, and a downstream turbine rotor 102, which may be the low pressure turbine rotor 46 of FIG. 1, are illustrated in FIG. 2. A mid-turbine frame 80 is positioned between the turbine rotors 100 and 102, and may carry a bearing such as the mid-turbine frame 57 of FIG. 1.

The mid-turbine frame 80 includes a vane stage 100 extending between platforms 106 and 108. A tie rod 116 extends through the vanes 110 and extends from an inner case 122 outwardly to be mounted in a mount structure 112 in an outer housing 114.

The tie rod 116 extends from an upstream end 118 to a downstream end 120. The ends 118 and 120 are separated by a distance $d_1$.

A base 182 of the tie rod is radially inward of the inner case 122. A forward bolt 124 extends through a forward flange 131 on the inner case 122, and through a forward portion of the platform 182 of the tie rod. As shown, the bolt 124 is not parallel to a line x which is parallel to the axis of the engine. Rather, the bolt 124 extends along an axis y which is spaced radially inward from the axis x. In embodiments, an angle A defined between an x and y may be 5 degrees. In embodiments, angle A is greater than or equal to 1 degree and less than or equal to 7 degrees.

Aft bolts 127 extend through the inner case 122 and further secure the platform 182. A rear bolt 150 extends through a rear flange 152 on the inner case 122 and also secures the platform 182.

A distance $d_2$ is defined between a point, which is the center of the bolt hole 126 at an interface of the flange 131, and the platform 182, and parallel to the axis x to a point, which is the center of the bolt hole 128, at the location between an interface of the inner case 122 and the platform 182. Distance $d_2$ is greater than or equal to distance $d_1$.

Figure 3:
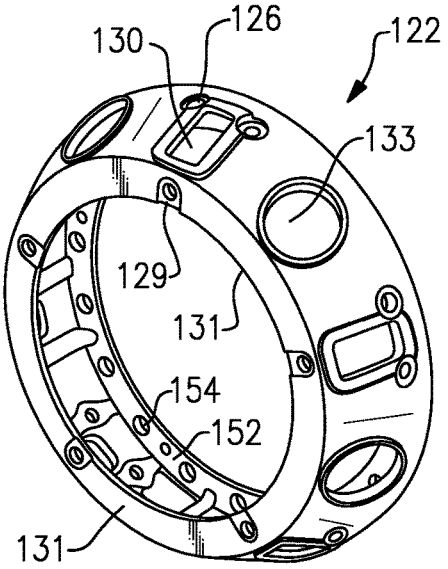
FIG. 3 shows a detail of an inner case.

As shown in FIG. 3, the inner case 122 has serviced tubes access holes 133, openings 130 to receive the tie rods 116, bolt holes 126, and forward bolt holes 129 in the forward flange 131. The rear flange 152 also has bolt holes 154.

Figure 4:
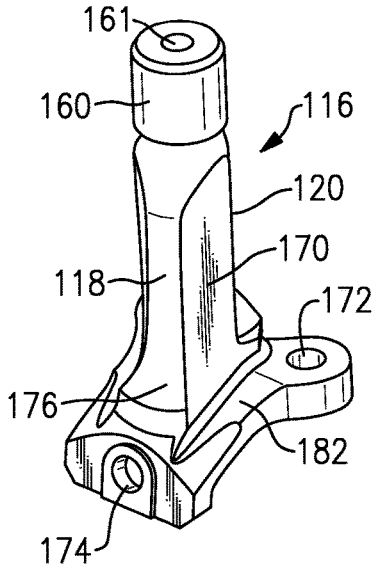
FIG. 4 shows a detail of a tie rod.

FIG. 4 shows a tie rod 116 having a cooling air opening 161 and a threaded portion 160 which is secured within the mount structure 112. Sides 170 are flat and are connected by curved ends 176 and another at end 120. Bolt holes 174 and 172 are shown in FIG. 4.

Figure 5:
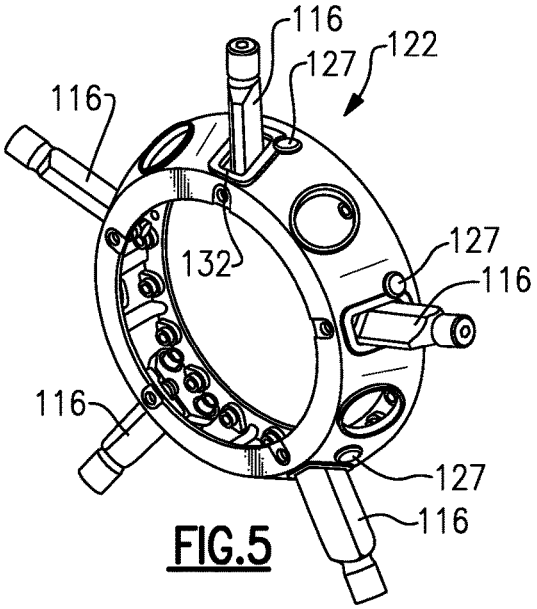
FIG. 5 shows an early step in the assembly of the mid-turbine frame.

Bolts 127 are fitted tightly to the case 122. Then, FIG. 5 shows a subsequent assembly step. The tie rods 116 are initially inserted through the inner case 122 and at least the bolts 127 secure the tie rods within the inner case 122. The assembled inner case and tie rods may then be mounted within the housing and the remainder of the mid-turbine frame 80.

Figure 6:
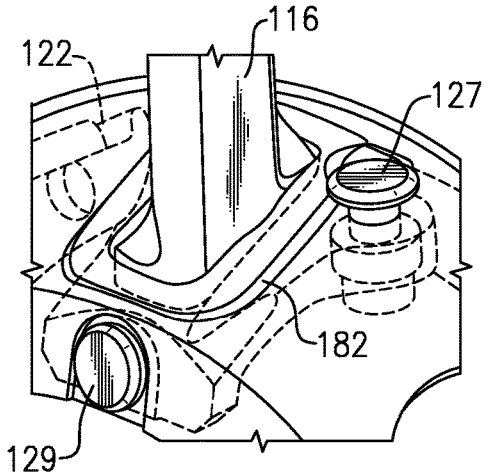
FIG. 6 is a detail of a tie rod and inner case.

FIG. 6 shows a detail of the tie rod 126, the inner case 122 and the bolts 124 and 127.

In a method of assembling the mid-turbine frame, the tie rods are initially moved radially outwardly through the inner case 122 and then secured. The tie rods are then secured within the housing 114, such as by having the mount member 112 tightened onto the threaded portion 160.

The tie rod base 182 is radially inward of the inner case 122. The bolts 127 are preferably generally parallel to an axis of the tie rod 116. The bolt 124 is preferably a slip fit within the flange 131 of the inner case 122.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A mid-turbine frame for use in a gas turbine engine comprising:

at least one vane extending between a vane inner platform and a vane outer platform; and an inner case radially inward of said inner platform, and a plurality of tie rods extending from a platform radially inward of said inner case to a radially outer location which is secured by a mount member, and said tie rods secured in said inner case by a forward bolt, and at least one rear bolt, with said forward bolt extending along an axis which is non-parallel to a center axis of said inner case, said forward bolt extending along an angle relative to a line parallel to said center axis, and said angle having a component extending radially inwardly relative to said center axis.

2. The mid-turbine frame as set forth in claim 1, wherein said angle is greater than or equal to 1 degree and less than or equal to 7 degrees.

3. The mid-turbine frame as set forth in claim 2, wherein there are a pair of said rear bolts extending through said inner case and into said inner platform of said tie rods and extending generally parallel to an axis of said tie rod.

4. The mid-turbine frame as set forth in claim 3, wherein a downstream most bolt extending through an inwardly extending downstream flange on said inner case, and into said tie rod platform.

5. The mid-turbine frame as set forth in claim 1, wherein there are a pair of said rear bolts extending through said inner case and into said inner platform of said tie rods and extending generally parallel to an axis of said tie rod.

6. The mid-turbine frame as set forth in claim 5, wherein a downstream most bolt extending through an inwardly extending downstream flange on said inner case, and into said tie rod platform.

7. The mid-turbine frame as set forth in claim 1, wherein a downstream most bolt extending through an inwardly extending downstream flange on said inner case, and into said tie rod platform.

8. The mid-turbine frame as set forth in claim 1, wherein said tie rods having threads at a radially outer end, and said threads being secured to said mount member.

9. A gas turbine engine comprising:

a compressor and a turbine section, with said turbine having at least an upstream turbine rotor and a downstream turbine rotor, and a mid-turbine frame mounted between said upstream and downstream turbine rotor; and the mid-turbine frame including at least one vane extending between a vane inner platform and a vane outer platform, an inner case radially inward of said inner platform, and a plurality of tie rods extending from a platform radially inward of said inner case to a radially outer location which is secured by a mount member, and said tie rods secured in said inner case by a forward bolt, and at least one rear bolt, with said forward bolt extending along an axis which is non-parallel to a center axis of said inner case, said forward bolt extending along an angle relative to a line parallel to said center axis, and said angle having a component extending radially inwardly relative to said center axis.

10. The gas turbine engine as set forth in claim 9, wherein said angle is greater than or equal to 1 degree and less than or equal to 7 degrees.

11. The gas turbine engine as set forth in claim 10, wherein there are a pair of said rear bolts extending through said inner case and into said inner platform of said tie rods and extending generally parallel to an axis of said tie rod.

12. The gas turbine engine as set forth in claim 11, wherein a downstream most bolt extending through an inwardly extending downstream flange on said inner case, and into said tie rod platform.

13. The gas turbine engine as set forth in claim 9, wherein said tie rods having threads at a radially outer end, and said threads being secured to said mount member.

14. The gas turbine engine as set forth in claim 9, wherein there are a pair of said rear bolts extending through said inner case and into said inner platform of said tie rods and extending generally parallel to an axis of said tie rod.

15. The gas turbine engine as set forth in claim 14, wherein a downstream most bolt extending through an inwardly extending downstream flange on said inner case, and into said tie rod platform.

16. The gas turbine engine as set forth in claim 15, wherein said tie rods having threads at a radially outer end, and said threads being secured to said mount member.

17. The gas turbine engine as set forth in claim 9, wherein a downstream most bolt extending through an inwardly extending downstream flange on said inner case, and into said tie rod platform.

18. A method for assembling a mid-turbine frame for a gas turbine engine comprising:

passing a plurality of tie rods radially outwardly through openings in an inner case having a platform positioned radially inwardly of said inner case, and securing said inner case to the platform of said tie rods with a forward bolt; and then securing said tie rods within a housing of a gas turbine engine, said forward bolt extending along an angle relative to a line parallel to said center axis, and said angle having a component extending radially inwardly relative to said center axis.

19. The method as set forth in claim 18, wherein the angle is greater than or equal to 1 degree and less than or equal to 7 degrees.

20. The method as set forth in claim 19, wherein there are a pair of rear bolts extending through said inner case and into said platform of said tie rods and extending generally parallel to an axis of said tie rod, and a downstream most bolt extending through an inwardly extending downstream flange on said inner case, and into said platform.

* * * * *